US011603177B1

(12) United States Patent
Granier et al.

(10) Patent No.: US 11,603,177 B1
(45) Date of Patent: Mar. 14, 2023

(54) FIREARM FOR UNMANNED UNDERWATER VEHICLES

(71) Applicant: Energetic Materials & Products, Inc., Round Rock, TX (US)

(72) Inventors: John Joseph Granier, Round Rock, TX (US); Dennis Eugene Wilson, Cedar Park, TX (US); Joel Brad Bailey, Austin, TX (US); Austin Paynter, Cedar Park, TX (US)

(73) Assignee: Energetic Materials and Products Inc., Round Rock, TX (US)

( * ) Notice: Subject to any disclaimer, the term of this patent is extended or adjusted under 35 U.S.C. 154(b) by 0 days.

(21) Appl. No.: 17/692,938

(22) Filed: Mar. 11, 2022

(51) Int. Cl.
*B63G 8/28* (2006.01)
*F41A 35/04* (2006.01)
*F41A 19/59* (2006.01)

(52) U.S. Cl.
CPC ..... *B63G 8/28* (2013.01); *F41A 19/59* (2013.01); *F41A 35/04* (2013.01)

(58) Field of Classification Search
CPC .. B63G 8/28; B63G 8/30; F41A 19/59; F41A 35/04; F41A 21/22; F41A 21/24; F41A 21/26; F41A 21/44
USPC ..... 42/1.14
See application file for complete search history.

(56) References Cited

U.S. PATENT DOCUMENTS

| | | | | |
|---|---|---|---|---|
| 2,804,804 | A * | 9/1957 | Cumming | F41A 1/04 89/27.13 |
| 4,505,018 | A * | 3/1985 | Regalbuto | F41C 9/06 411/441 |
| 8,915,004 | B1 * | 12/2014 | Langner | F42B 12/02 42/69.01 |
| 9,200,881 | B1 * | 12/2015 | Langner | F42B 33/06 |
| 9,322,625 | B1 * | 4/2016 | Langner | F41B 9/0046 |
| 10,495,433 | B1 * | 12/2019 | Langner | F41H 11/12 |
| 10,953,967 | B2 * | 3/2021 | Bergman | B63G 7/00 |
| 11,243,038 | B1 * | 2/2022 | Langner | F41A 21/10 |
| 2010/0212480 | A1 * | 8/2010 | Bell | F42B 3/24 89/1.15 |
| 2018/0281911 | A1 * | 10/2018 | Bergman | B63G 8/001 |
| 2019/0101344 | A1 * | 4/2019 | Polovnev | F41C 9/06 |

* cited by examiner

*Primary Examiner* — John Cooper
(74) *Attorney, Agent, or Firm* — Antony P. Ng; Russell Ng PLLC

(57) ABSTRACT

An underwater firearm is disclosed. The underwater firearm includes a barrel for receiving an ammunition on a first end and a barrel cap for covering a second end of the barrel. The underwater firearm also includes a capsule having a firing pin and contains a reactive material. The reactive material can be ignited by an electrical ignitor in order to propel the firing pin to strike the ammunition. A housing is utilized to contain the capsule and the electrical ignitor.

20 Claims, 5 Drawing Sheets

FIREARM FOR UNMANNED UNDERWATER VEHICLES

TECHNICAL FIELD

The present invention relates to firearms in general, and in particular to a small to medium caliber firearm for unmanned underwater vehicles.

BACKGROUND

Firearms for unmanned ground vehicles are well-known. Mounted on a robotic vehicle, a firearm can be aimed using a live video feed, and can be fired via remote control by a human operator. In addition, the vehicle is designed and fabricated to handle the recoil forces of the firearm.

Unmanned underwater vehicles are commonly used for video and sonar surveillance. Designing a firearm to function underwater and not overburden or damage the unmanned underwater vehicle is much more difficult compared to an unmanned ground vehicle. A recoilless firearm having a heavy inert projectile would require an increase of the propellant charge weight and an increase in the length and weight of the barrel for accelerating the inert projectile. Furthermore, the propellant gas exhausting from the barrel into the opposite side of the shot can create a hydraulic shock, the impact of which on the gun carriage and on the firearm carrier is much greater than the recoil from a shot of a traditional firearm.

The present disclosure provides a firearm to be used in unmanned underwater vehicles.

SUMMARY OF THE INVENTION

In accordance with one embodiment, an underwater firearm includes a barrel for receiving an ammunition on a first end and a barrel cap for covering a second end of the barrel. The underwater firearm also includes a capsule having a firing pin and contains a reactive material. The reactive material can be ignited by an electrical ignitor in order to propel the firing pin to strike the ammunition. A housing is utilized to contain the capsule and the electrical ignitor.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
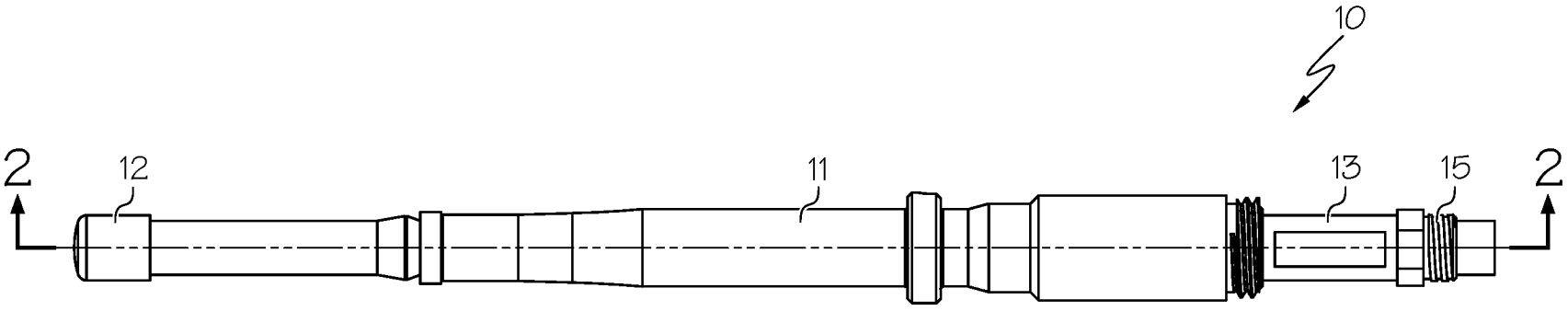
FIG. 1 is a plain view of a firearm for small-sized unmanned underwater vehicles, in accordance with one embodiment.
Figure 2:
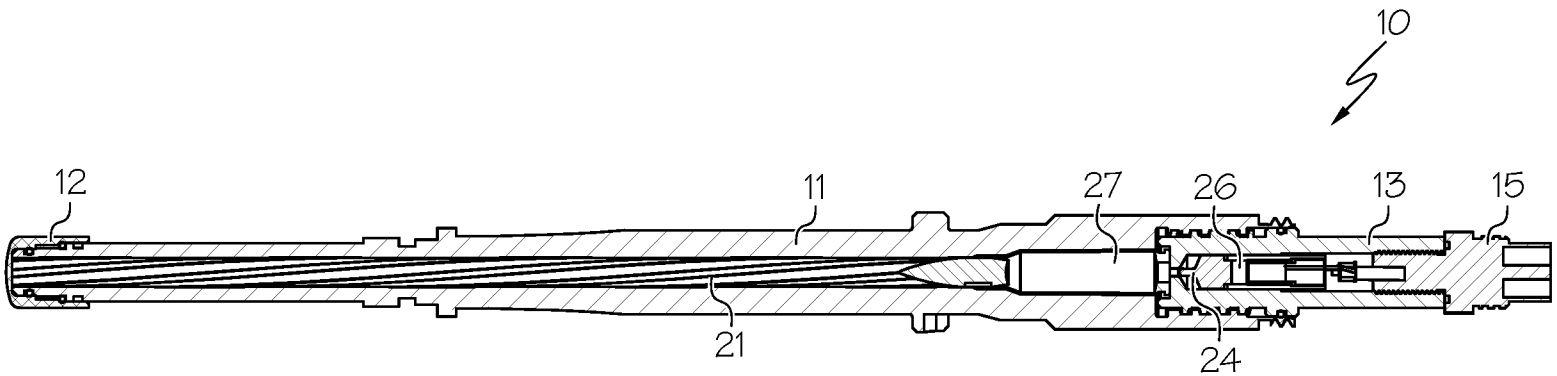
FIG. 2 is a cross-sectional view of the firearm from FIG. 1, in accordance with one embodiment.
Figure 3:
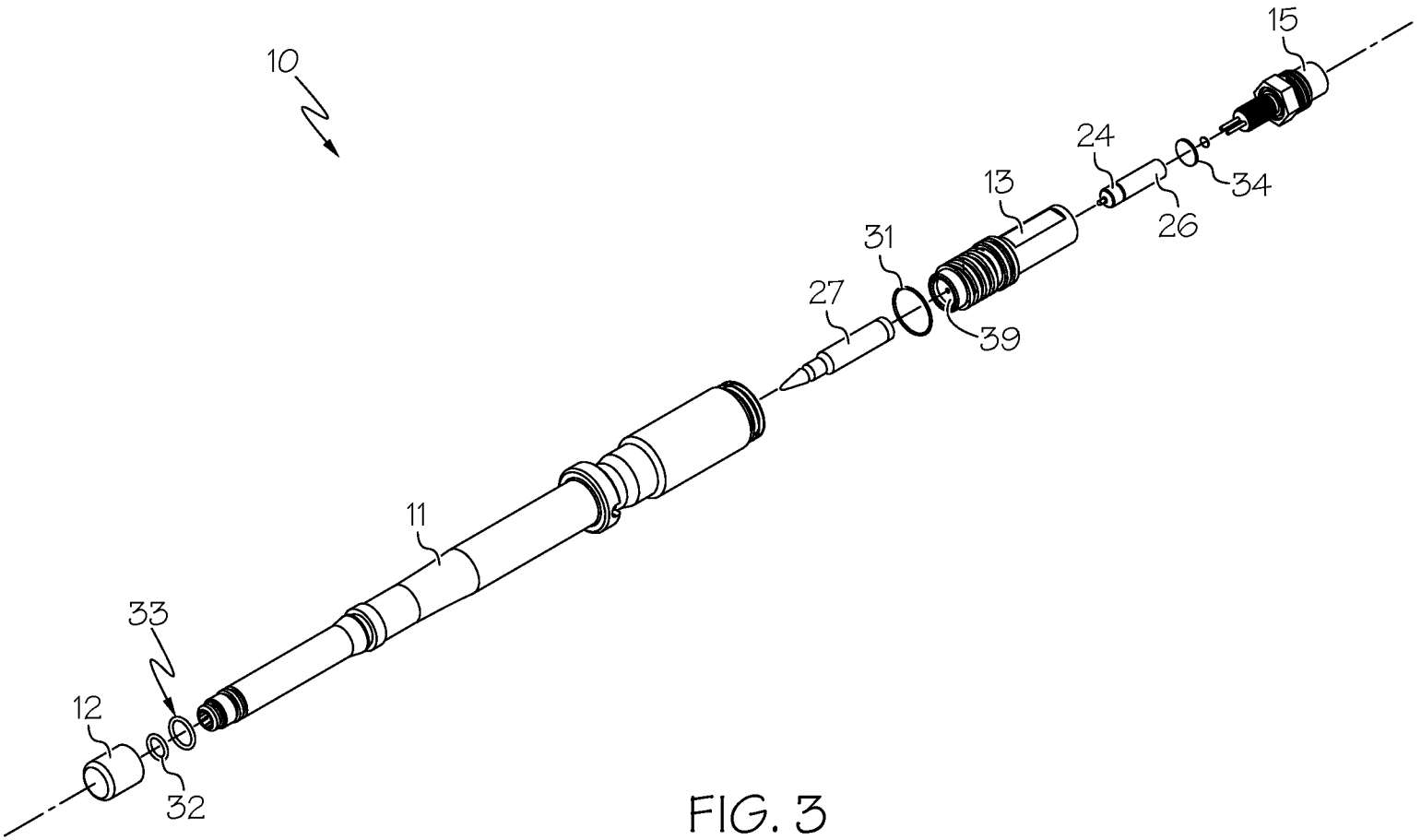
FIG. 3 is an exploded isometric view of the firearm from FIG. 1, in accordance with one embodiment.

Referring now to the drawings and in particular to FIG. 1, there is illustrated a plain view of a firearm for small-sized unmanned underwater vehicles, in accordance with one embodiment. FIG. 2 is a cross-sectional view of the firearm from FIG. 1 along line 2-2, and FIG. 3 is an exploded isometric view of the firearm from FIG. 1. As shown, a firearm 10 includes a barrel 11, a barrel cap 12, a housing 13, a capsule 26, and an electrical plug 15. Barrel 11 is a hollow metal tube having a first open end and a second open end that can be referred to as the chamber and the muzzle, respectively. The inside of barrel 11 includes rifling twist 21 consisting of lands and grooves to induce a rotation in a projectile. Alternatively, the inside of barrel 11 can be a smooth bore or cylindrical.

An ammunition cartridge 27 can be loaded into barrel 11 from the first end of barrel 11. In order to prevent water from entering barrel 11 when firearm 10 is submersed under water, the first end of barrel 11 can be covered by housing 13 along with an O-ring 31, and the second end of barrel 11 can be covered by a barrel cap 12 along with two O-rings 32, 33.

Housing 13 is a metal tube having a first end and a second end. The first end of housing 13 fits with the first end of barrel 11 via O-ring 31. The second end of housing 13 fits with electrical plug 15 via an O-ring 34. Electrical plug 15 may be contained and sealed inside capsule 26. Electrical plug 15 is designed for underwater use, and it includes a combination of bonded conductor and insulator materials.

Capsule 26 can be inserted within housing 13. A firing pin 24 is connected to a first end of capsule 26. The second end of capsule 26 is also configured to receive electrical plug 15. Capsule 26 contains an electrical ignitor 40.

Figure 4:
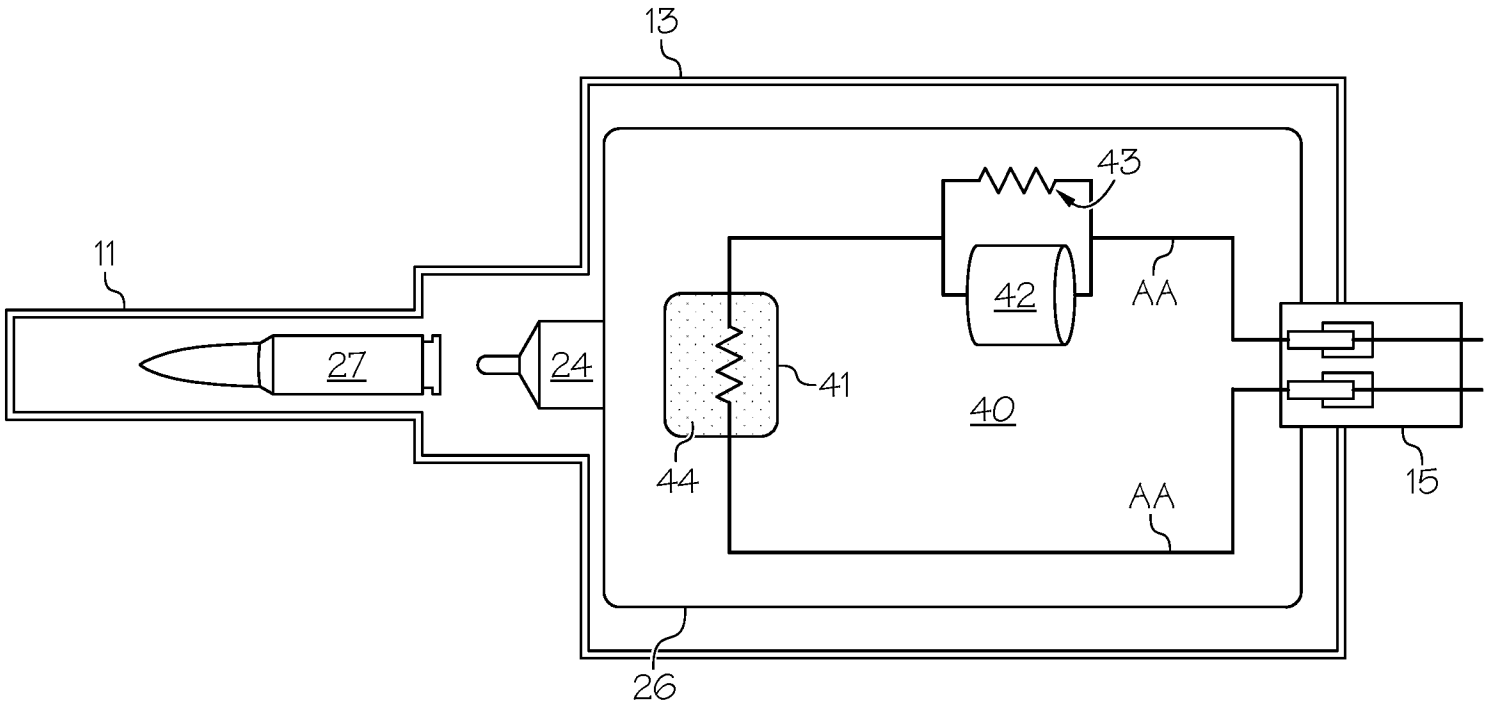
FIG. 4 is a circuit diagram of an electrical ignitor within the firearm from FIG. 1, according to one embodiment.

With reference now to FIG. 4, there is illustrated a circuit diagram of electrical ignitor 40, according to one embodiment. As shown, electrical ignitor 40 includes a bridge resistor 41 and a threshold activated interrupt 42. Bridge resistor 41 is embedded within or adjacent to a reactive material 44 such that reactive material 44 can be ignited by bridge resistor 41 when bridge resister 41 has reached a predetermined temperature. Threshold activated interrupt 42 functions as a safety switch for electrical ignitor 40. Threshold activated interrupt 42 is connected in parallel with a bridge resistor 43. Threshold activation interrupt 42 can be a pressure valve (to be activated based on the water depth of firearm 10), a time status (to be activated based on time since deployment), a module for receiving commands remotely, a voltage threshold module, or an insertion/removal of a safety key. The safety key concept would be human interaction with an unmanned underwater vehicle to arm firearm 10.

For electrical ignitor 40, at least 0.5 μA current is needed to provide ignition. The current can be provided from an unmanned underwater vehicle, such as unmanned underwater vehicle 50 from FIG. 5, via electrical plug 15. The current can also be provided by electric wires connected to an electric power supply or by a remote acoustic, radio frequency, optic communication device closing a switch to a battery pack controlled by a human operator. It is understood by those skilled in the art that electric current can also be provided by many other types of circuits and power supplies.

The electrical current in wires AA within electrical ignitor 40 must be high enough in order to ignite reactive material 44 contained within capsule 26. After bridge resister 41 has reached a predetermined temperature, reactive material 44 will be ignited. The gas expansion generated by the explosion of reactive material 44 then pushes firing pin 24 through a small opening 39 located in the first end of housing 13, which in turn, strikes a percussion primer (not shown) at one end of ammunition cartridge 27. As a result, the projectile (or bullet) of ammunition cartridge 27 will separate from the case (or shell) of ammunition cartridge 27 and travels along the bore of barrel 11 to exit through the second end of barrel 11, while the casing of ammunition cartridge 27 remains at the first end of barrel 11. The force of the projectile exiting the second end of barrel 11 is more than sufficient to break the thin material of plastic or metal barrel cap 12.

Figure 5:
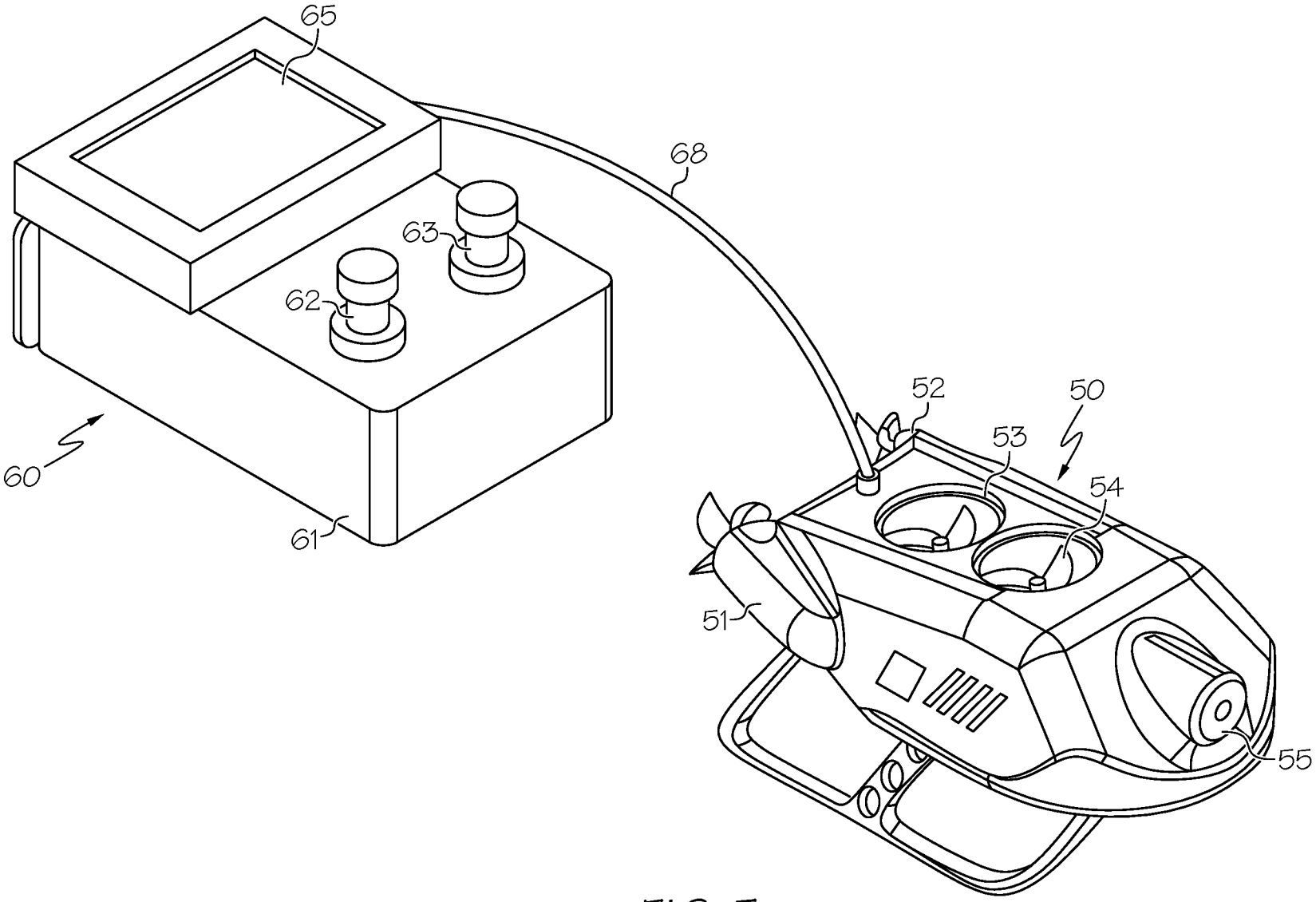
FIG. 5 is an isometric view of an unmanned underwater vehicle on which the firearm from FIG. 1 can be installed.

Referring now to FIG. 5, there is illustrated an isometric view of an unmanned underwater vehicle on which firearm 10 can be installed. As shown, an unmanned underwater vehicle 50 includes horizontal propulsion systems 51-52 and vertical propulsion systems 53-54. Unmanned underwater vehicle 50 includes a camera 55 for providing images of the underwater conditions. It is appreciated by one skilled in the art that unmanned underwater vehicle 50 has many uses, including recreational, search and rescue, undersea investigation, etc.

Unmanned underwater vehicle 50 can be controlled by a control unit 60. As shown, control unit 60 includes a rugged chassis 61 sufficient to house and protect an electronic circuitry (not shown) used to control unmanned underwater vehicle 50. Control unit 60 may include joysticks 62, 63 adapted to provide input from a user for maneuvering unmanned underwater vehicle 50 while unmanned underwater vehicle 50 is submerged under water. Control unit 60 also includes a display 65 adapted to display images obtained by camera 55 of unmanned underwater vehicle 50. A flexible cable 68 can be utilized to connect control unit 60 to unmanned underwater vehicle 50 to allow unmanned underwater vehicle 50 to transmit and receive signals between control unit 60 to unmanned underwater vehicle 50. Firearm 10 (not shown in FIG. 5) can be mounted to the unmanned underwater vehicle 50 by many designs of varying mechanical linkages. Typically, the firearm 10 is mounted in view of camera 55 to allow a driver to aim the firearm by tilt, pitch and rotation of the vehicle. In one embodiment, the firearm is attached with a rigid joint that is purposely designed to release or break at a low force which can be referred to as a slip mechanism. This slip mechanism keeps the firearm in position for driving and aiming but then releases to minimize peak recoil forces transmitted to the vehicle.

Figure 6:
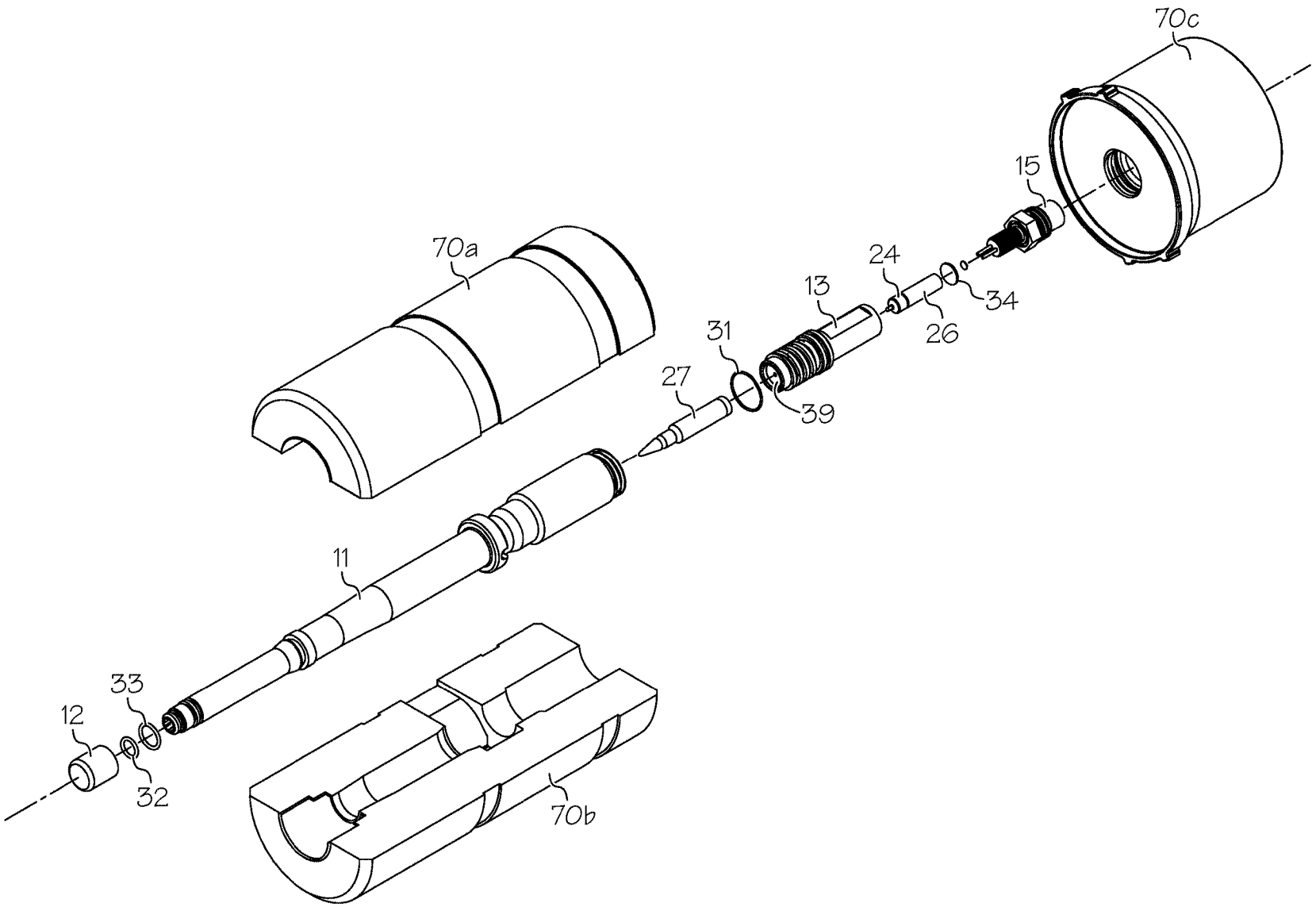
FIG. 6 is an isometric view of the firearm from FIG. 1 assembled with a floatation cover, in accordance with one embodiment.

With reference now to FIG. 6, there is illustrated an isometric view of the firearm from FIG. 1 assembled with a floatation cover, in accordance with one embodiment. As shown, a floatation cover 70 surrounds part of barrel 11 and all of housing 13 and electrical ignitor 15. The purpose of floatation cover 70 is to provide proper buoyancy for firearm 10 under water when firearm 10 is mounted on an unmanned underwater vehicle submerged under water. Floatation cover 70 is made of rigid closed cell polymer foam material. The foam must be capable of surviving underwater pressure conditions. The foam can be designed with a rigid polymer (glass reinforced nylon) shell to survive the gun recoil. For the present embodiment, floatation cover 70 includes two half modules **70*a*-70*b* and an end cap module 70*c*, as shown in FIG. 3**, although it is understood by those skilled in the art that many configurations are also acceptable.

Floatation cover 70 provides independent neutrality such that the attachment of firearm 10 to an unmanned underwater vehicle will not cause the unmanned underwater vehicle to float or sink, and will not create unnecessary torque that can make the unmanned underwater vehicle unstable or difficult to maneuver. Independent neutrality also allows for the firearm to detach during its recoil event without affecting the stability of the unmanned underwater vehicle.

Floatation cover 70 does not prohibit function of firearm 10 before or during shooting. Floatation cover 70 also allows access for loading ammunition and closing the breach.

As has been described, the present invention provides a firearm for small-sized unmanned underwater vehicles.

While the invention has been particularly shown and described with reference to a preferred embodiment, it will be understood by those skilled in the art that various changes in form and detail may be made therein without departing from the spirit and scope of the invention.

What is claimed is:

1. An underwater firearm comprising:
- a barrel for receiving an ammunition on a first end;
- a housing for covering said first end of said barrel;
- a barrel cap for covering a second end of said barrel; and
- a capsule, contained within said housing, for enclosing
  - a firing pin;
  - a reactive material;
  - a pressure valve for allowing said underwater firearm to be activated at a predetermined water depth; and
  - an electrical ignitor for igniting said reactive material to propel said firing pin to strike said ammunition in said barrel.

2. The underwater firearm of claim 1, wherein said electrical ignitor includes a bridge resistor embedded within said reactive material.

3. The underwater firearm of claim 1, wherein said pressure valve that functions as a safety switch is connected in parallel with a bridge resistor.

4. The underwater firearm of claim 1, wherein said underwater firearm is covered by a set of buoyancy modules.

5. The underwater firearm of claim 1, wherein a bore within said barrel is smooth.

6. The underwater firearm of claim 1, wherein a bore within said barrel includes a set of rifling twist.

7. The underwater firearm of claim 1, wherein said underwater firearm includes a slip mount.

8. An underwater firearm comprising:
- a barrel for receiving an ammunition on a first end;
- a housing for covering said first end of said barrel;
- a barrel cap for covering a second end of said barrel; and
- a capsule, contained within said housing, for enclosing
  - a firing pin;
  - a reactive material;
  - a timer for allowing said underwater firearm to be activated after a predetermined amount of time has lapsed since deployment; and
  - an electrical ignitor for igniting said reactive material to propel said firing pin to strike said ammunition in said barrel.

9. The underwater firearm of claim 8, wherein said electrical ignitor includes a bridge resistor embedded within said reactive material.

10. The underwater firearm of claim 8, wherein said said timer that functions as a safety switch is connected in parallel with a bridge resistor.

11. The underwater firearm of claim 8, wherein said underwater firearm is covered by a set of buoyancy modules.

12. The underwater firearm of claim 8, wherein a bore within said barrel is smooth.

13. The underwater firearm of claim 8, wherein a bore within said barrel includes a set of rifling twist.

14. The underwater firearm of claim 8, wherein said underwater firearm includes a slip mount.

15. An unmanned underwater vehicle, comprising:

a submersible body having a plurality of horizontal and vertical propulsion systems;

a control unit connected to said unmanned underwater vehicle via a flexible cable; and an underwater firearm mounted on said unmanned underwater vehicle, wherein said underwater firearm includes:

a barrel for receiving an ammunition on a first end;

a housing for covering said first end of said barrel;

a barrel cap for covering a second end of said barrel;

a capsule, contained within said housing, for enclosing a firing pin;

a reactive material;

a threshold activated interrupt serving as a safety switch; and an electrical ignitor for igniting said reactive material to propel said firing pin to strike said ammunition in said barrel, wherein said electrical ignitor is controlled by said control unit.

16. The unmanned underwater vehicle of claim 15, wherein said electrical ignitor includes a bridge resistor embedded within said reactive material.

17. The unmanned underwater vehicle of claim 15, wherein said threshold activated interrupt is a pressure valve for allowing said underwater firearm to be activated at a predetermined water depth.

18. The unmanned underwater vehicle of claim 17, wherein said pressure valve is connected in parallel with a bridge resistor.

19. The unmanned underwater vehicle of claim 15, wherein said threshold activated interrupt is a timer for allowing said underwater firearm to be activated after a predetermined amount of time has lapsed since deployment.

20. The unmanned underwater vehicle of claim 19, wherein said timer is connected in parallel with a bridge resistor.

* * * * *